United States Patent [19]

Hayakawa et al.

[11] 4,382,645

[45] May 10, 1983

[54] APPARATUS FOR SEALING LAMP MOUNT TO LAMP TUBE

[75] Inventors: Masatoshi Hayakawa, Nagoya; Masahiro Tanioka, Komaki, both of Japan

[73] Assignee: CKD Corporation, Komaki, Japan

[21] Appl. No.: 178,629

[22] Filed: Aug. 15, 1980

[30] Foreign Application Priority Data

Jan. 21, 1980 [JP] Japan ..... 55-5467

[51] Int. Cl.[3] ..... H01J 9/46

[52] U.S. Cl. ..... 445/69; 65/155; 445/70

[58] Field of Search ..... 29/25.19; 65/138, 153, 65/155; 316/19, 31

[56] References Cited

U.S. PATENT DOCUMENTS

| | | | |
|---|---|---|---|
| 1,989,897 | 2/1935 | Anderson et al. | 316/31 |
| 2,413,766 | 1/1947 | Honzl | 65/153 |
| 2,417,361 | 3/1947 | Herzog | 316/19 |
| 3,113,011 | 12/1963 | Gilbert, Jr. et al. | 65/155 X |
| 4,184,728 | 1/1980 | Grenfell et al. | 316/31 |

FOREIGN PATENT DOCUMENTS

| | | | |
|---|---|---|---|
| 54-37438 | 11/1979 | Japan . | |
| 55-39150 | 3/1980 | Japan | 316/19 |

*Primary Examiner*—Kenneth J. Ramsey

*Attorney, Agent, or Firm*—Wenderoth, Lind & Ponack

[57] ABSTRACT

An apparatus for sealing a lamp mount having a coil mounted thereon to an end of a lamp tube is provided with chuck means releasably holding a lamp tube; an evacuator body axially movable with respect to the lamp tube, the evacuator body having a vacuum chamber into which an end of an evacuator pipe on the lamp mount is inserted; and a burner device for heating the flare of the lamp mount and an end of the lamp tube provided between said evacuator body and the end of the lamp tube, said burner device having a burner body with a burner tank and a number of burner nozzles.

4 Claims, 8 Drawing Figures

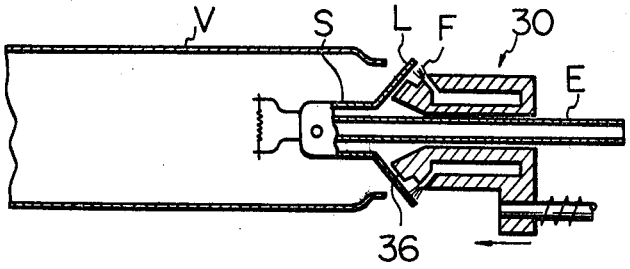
Fig. 5A
Fig. 5B
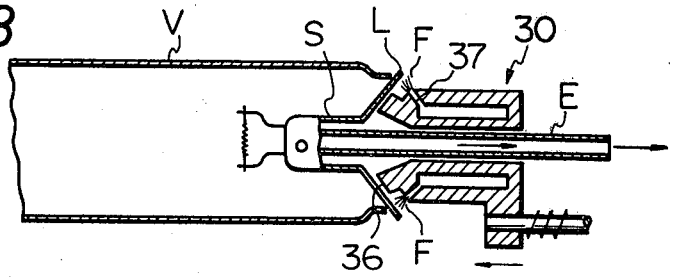
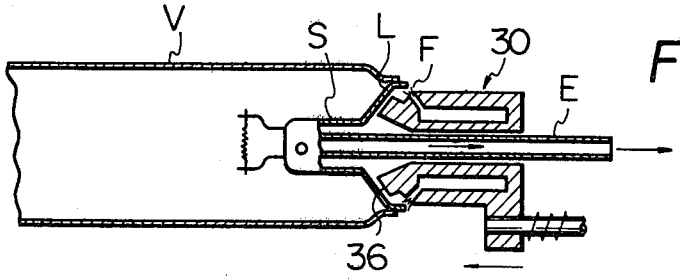
Fig. 5C
Fig. 5D
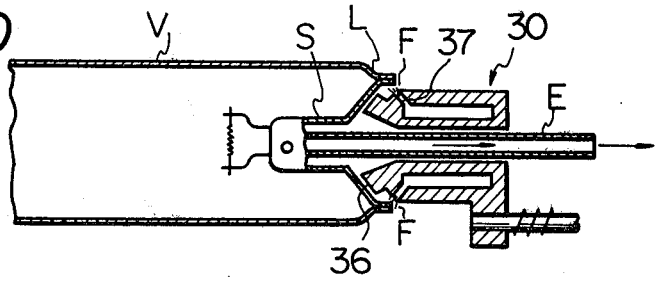

APPARATUS FOR SEALING LAMP MOUNT TO LAMP TUBE

BACKGROUND OF THE INVENTION

In apparatuses for sealing a lamp mount to a lamp tube of the prior art, the lamp mount was heretofore sealed to an end of the lamp tube by pushing the lamp mount having a filament coil mounted thereon into the end of the lamp tube, heating a flare of said lamp mount with a burner until it was softened, urging the softened flare of the lamp mount against the end of the lamp tube with a pusher plate into a close contact therewith, and heating the flare and the end of the lamp tube simultaneously and sufficiently until they were softened and fused together into a completely sealed condition.

In this conventional sealing apparatus, however, since the pusher plate was not specifically heated, it suffered from a disadvantage that the urging of the flare of the lamp mount caused a temporary cooling of the flare so that the reheating and softening of the flare was not effected speedily and efficiently.

Further, since the flare and the end of the glass lamp tube were merely mechanically urged together by the pusher plate, it was sometimes difficult to effect a close contact therebetween particularly when the end face of the lamp tube was more or less inclined or when the flare of the lamp mount was somewhat distorted and, accordingly, it was necessary to use special care in reheating them until they fused and it was difficult to perform the sealing step at a high speed.

SUMMARY OF THE INVENTION

The present invention relates to an apparatus for sealing a lamp mount to an end of a lamp tube used in the manufacture of tubular lamps such, for example, as fluorescent lamps.

An object of the present invention is to provide a new apparatus for sealing the lamp mount to the end of the lamp tube speedily and securely.

The apparatus according to the present invention has chuck means releasably holding a lamp tube; an evacuator body axially movable with respect to the lamp tube, said evacuator body having a vacuum chamber into which an end of an evacuator pipe of the lamp mount is inserted; and burner means for heating the flare of the lamp mount and an end of the lamp tube provided between said evacuator body and the end of the lamp tube, said burner means having a burner body with a burner tank and a number of burner nozzles.

BRIEF DESCRIPTION OF THE DRAWINGS

The invention will be better understood from the following description taken in connection with the accompanying drawings in which:

FIG. 5A to 5D are partial sectional views illustrative of the steps of the method for sealing the lamp mount to the lamp tube according to the present invention.

DETAILED DESCRIPTION OF THE PREFERRED EMBODIMENTS

Figure 1:
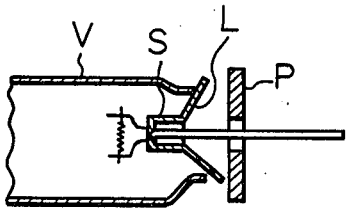
FIG. 1 is a partial sectional view illustrative of the conventional sealing method.

Before describing the embodiment of the present invention, the conventional sealing method practiced in apparatuses of the prior art will be described with reference to FIG. 1. In the conventional method, as shown in FIG. 1, a lamp mount S having a filament coil mounted thereon was pushed into an end of a lamp tube V, a flare L of the lamp mount S was heated by a burner until it was softened, the softened flare of the lamp mount was urged by a pusher plate P against the end of the lamp tube into a close contact therewith, and the flare L and the end of the lamp tube were heated simultaneously and sufficiently until they were softened and fused together to form a complete seal therebetween.

In this sealing method, however, since the pusher plate P was not specifically heated, there was a disadvantage that the flare L was temporarily cooled by the pusher plate P urged thereagainst and, therefore, the reheating and softening of the flare was not effected speedily and the operation efficiency was not increased.

Figure 2:
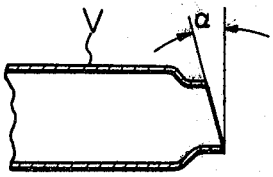
FIG. 2 is a partial sectional view illustrative of the shape of an end of a fluorescent tube.

Further, since the flare of the lamp mount and the end of the glass lamp tube were merely mechanically urged together by the pusher plate, it was sometimes difficult to effect a close contact therebetween particularly when, as shown in FIG. 2, the end face of the lamp tube V was at an angle of inclination $\alpha$ or when the flare of the lamp mount itself was somewhat distorted and, accordingly, it was necessary to use greater care in reheating them to fuse them and it was difficult to speed up the sealing step.

Figure 3:
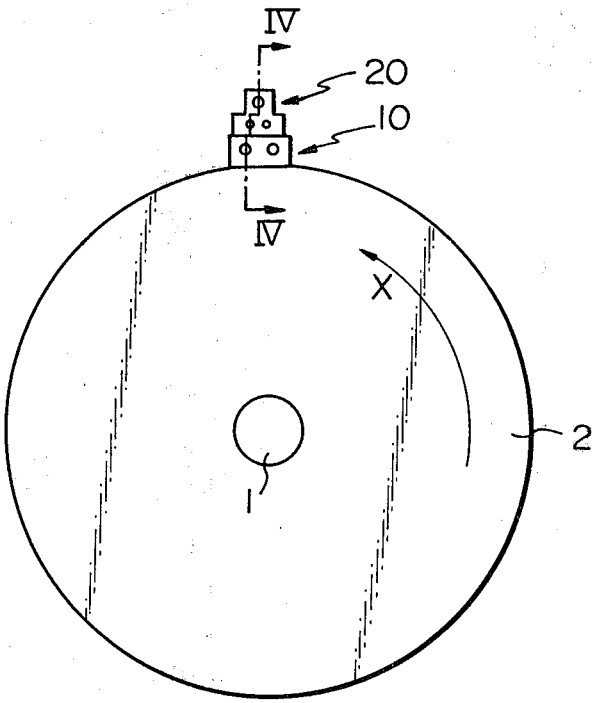
FIG. 3 is a schematic end view of an apparatus for sealing a lamp mount to a lamp tube according to the present invention.

An embodiment of the sealing apparatus for sealing the lamp mount to the lamp tube according to the present invention will now be described in detail with reference to FIGS. 3 and 4. The sealing apparatus 20 is provided in combination with a plurality of equally spaced lamp tube holding chucks 10 (only one thereof is shown in the drawings) disposed on the periphery of a spider 2 mounted on a shaft 1 rotated around a substantially horizontal axis by a known drive mechanism (not illustrated).

Figure 4:
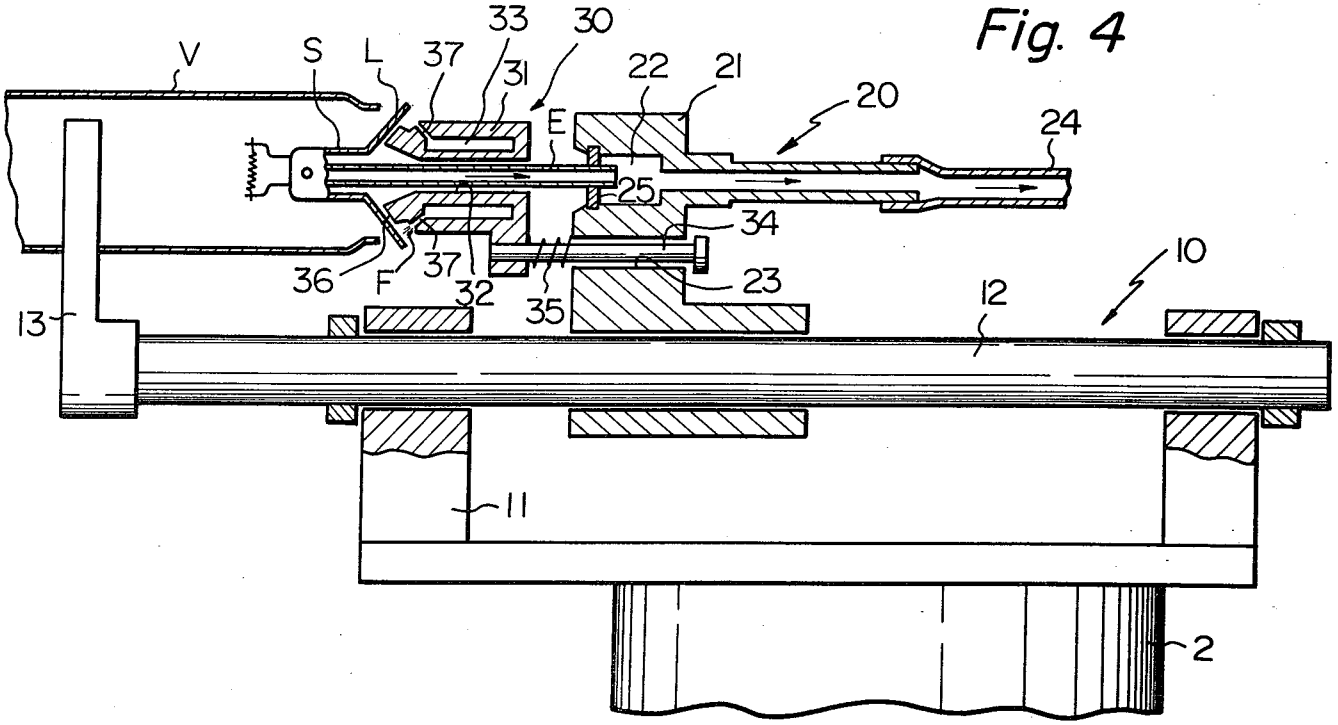
FIG. 4 is a sectional view taken along the line IV—IV of FIG. 3, illustrative of the principle of the apparatus according to the present invention.

The lamp tube chuck 10 has a frame 11 fixed on the outer periphery of the spider 2, a pair of support shafts 12 mounted rotatably in parallel to each other on the frame 11, and a pair of claws 13 (only one thereof is shown in FIG. 4) fixed at the front ends (lefthand ends in FIG. 4) of the support shafts for holding the lamp tube V. The support shafts 12 are rotated by a known method so as to grasp a lamp tube in the chuck 10 and to release the tube therefrom.

On the support shafts 12 is mounted an evacuator body 21 axially slidably. In the evacuator body 21 are formed a vacuum chamber 22 into which an end of an evacuator pipe E of the lamp mount S is inserted and a pair of holes 23 provided therethrough in parallel to the support shafts 12. The vacuum chamber 22 is adapted to be connected to a known vacuum source (not shown) through a conduit 24. At the entrance of the vacuum chamber 22 is mounted a seal member 25 engaged around the evacuator pipe E to seal the vacuum chamber 22 from the atmosphere.

A burner 30 is provided in front of the evacuator body 21, that is on the side thereof toward the lamp tube V. The burner 30 has a hole 32 for receiving therethrough the evacuator pipe E and a burner body 31 having therein an annular burner tank 33 surrounding the hole 32. The burner body 31 is fixed at the front end (the lefthand end in FIG. 4) of a rod 34 movably inserted in the hole 23 of the evacuator body 21 and is urged forward (leftward in FIG. 4) together with the rod 34 by a spring 35. At the front end of the burner body 31 is formed a conical portion 36 having a shape corresponding to the inclination of the flare L of the lamp mount S to be held thereby. The conical portion 36 is provided on the outer periphery thereof with a number of burner nozzles 37 extending at an angle from the burner tank 33 which is connected by known means to a fuel gas source (not shown) so as to be supplied with the fuel gas.

A lamp tube chuck 10 and a sealing apparatus 20 having the constructions described above are provided in proximity to both the ends of the lamp tube so as to seal the lamp mounts simultaneously to both the ends of the lamp tube while they are moving stepwise in the direction of the arrow X with the stepwise rotation of the spider 2 with the lamp tube held in the horizontal position. In this specification, however, the apparatus provided only at one end of the lamp tube is described for simplification's sake.

The lamp tube may be evacuated from only one end thereof.

Now, the operation of the sealing apparatus according to the present invention and having the construction described above will be explained with reference to FIGS. 5A to 5D. The burner 30 is operated while the apparatus is in the holding position of FIG. 4 and the sealing apparatus 20 is moved forward while heating the flare L by burner flames F from the burner nozzles 37 (FIG. 5A), whereby the lamp tube V and the lamp mount S are joined together and further the lamp mount S is urged into the end of the lamp tube (FIG. 5B) by the pressure of the spring 35. At this point, since the flare L is gradually softened into a shape compatible with the end of the lamp tube, the burner flames F heat and soften both the flare L and the end of the lamp tube at the same time into the fused state as desired (FIG. 5C). At this point, by connecting the vacuum chamber 33 of the evacuator body 21 to the source of vacuum while continuing the heating by the burner the air within the lamp tube V is evacuated through the evacuator pipe E and the pressure is reduced. The lamp mount S on which the atmospheric pressure is acting is further urged into the end of the lamp tube V by the difference in pressure caused between the inside and the outside of the lamp mount S, and thus the complete sealing is effected and the mounts thereby coupled and fused by the heat from the burner (FIG. 5D).

In the apparatus according to the present invention, as described hereinabove, in which both the members to be joined are simultaneously heated and softened and are uniformly and closely joined utilizing the atmospheric pressure, even where the two members are not completely fused with each other in some locations during the course of sealing, their fusion is promoted by the evacuation of the lamp tube. Thus, the completely fused condition of the entire fluorescent lamp is achieved. Further, even where the end of the lamp tube is inclined or somewhat uneven due to damage, since such an irregularity in dimensional accuracy is absorbed during the fusing, the apparatus according to the present invention provides further effects such as easing of the requirement for high accuracy of the parts and the lowering of the production cost.

While we have described and illustrated a presently preferred method of practising the invention, it is to be distinctly understood that the invention is not limited thereto but may be otherwise variously practised within the scope of the invention, as defined in the appended claims.

What is claimed is:

1. An apparatus for sealing a lamp mount having a coil mounted thereon to an end of a lamp tube, comprising:

a rotatable member;

horizontal support means on the other periphery of said rotatable member;

chuck means for releasably holding a lamp tube and mounted on an end said horizontal support means;

an evacuator body slidably mounted on said support means and having a vacuum chamber therein into which an end of an evacuator pipe forming part of said lamp mount is sealably insertable; and burner means for heating the flare of a lamp mount and an end of a lamp tube held by said chuck means, said burner means including a burner body disposed between said chuck means and said evacuator body and having a burner tank and a number of burner nozzles therein directed for heating the flare and the end of the lamp tube, at least one rod axially slidably mounted in said evacuator body for movably mounting said burner body on said evacuator body for movement toward and away from said chuck means, and means for biasing said burner body toward said chuck means with respect to said evacuator body.

2. An apparatus accordng to claim 1, in which said burner body has at the end thereof facing toward said clamp means a conical surface adapted to contact with the flare of the lamp mount, and said burner nozzles being provided near the outer periphery of said conical surface.

3. An apparatus according to claim 2, in which said burner body has a hole therethrough for receiving the evacuator pipe, said burner tank being annular and surrounding the hole.

4. An apparatus according to claim 1, in which said burner body has a hole therethrough for receiving the evacuator pipe, said burner tank being annular and surrounding the hole.

* * * * *